United States Patent [19]

Schnippering et al.

[11] Patent Number: 4,833,864

[45] Date of Patent: May 30, 1989

[54] METHOD AND APPARATUS FOR CLOSING CONTAINERS

[76] Inventors: Horst F. Schnippering, Deitenbecke 23, D-5980 Werdohl-Eveking; Peter Stenzel, Amselweg 7, D-5974 Herscheid, both of Fed. Rep. of Germany

[21] Appl. No.: 27,648

[22] Filed: Mar. 19, 1987

[30] Foreign Application Priority Data

Mar. 20, 1986 [DE] Fed. Rep. of Germany ..... 3609462

[51] Int. Cl.[4] ..... B65B 7/28

[52] U.S. Cl. ..... 53/485; 53/296; 53/300

[58] Field of Search ..... 53/296, 300, 303, 368, 53/378, 484, 485, 488

[56] References Cited

U.S. PATENT DOCUMENTS

| | | | |
|---|---|---|---|
| 2,975,574 | 3/1961 | Jorgenson et al. | 53/378 X |
| 3,283,469 | 11/1966 | McBrady et al. | 53/485 X |
| 3,724,161 | 4/1973 | Vermeulen | 53/488 |
| 3,850,780 | 11/1974 | Crawford et al. | 156/583 |
| 3,890,767 | 6/1975 | Cawrse | 53/296 |
| 3,908,334 | 9/1975 | Rychiger | 53/296 X |
| 4,065,909 | 1/1978 | Mueller | 53/296 X |
| 4,287,702 | 9/1981 | Corbic | 53/484 X |
| 4,691,500 | 9/1987 | Danforth et al. | 53/300 X |

FOREIGN PATENT DOCUMENTS

| | | | |
|---|---|---|---|
| 0136423 | 4/1985 | European Pat. Off. . | |
| 2053324 | 8/1972 | Fed. Rep. of Germany . | |
| 7413122 | 4/1975 | Fed. Rep. of Germany | 53/378 |
| 2901702 | 7/1979 | Fed. Rep. of Germany . | |
| 2913026 | 6/1982 | Fed. Rep. of Germany . | |
| 2229612 | 12/1974 | France . | |
| 923741 | 4/1963 | United Kingdom . | |

*Primary Examiner*—James F. Coan
*Assistant Examiner*—Steven P. Weihrouch
*Attorney, Agent, or Firm*—Cooper & Dunham

[57] ABSTRACT

The present invention relates to a method and an apparatus for closing containers with a cover foil. In the method and with the apparatus of the invention, the containers are conveyed without change in vertical position and without stopping between rotation systems bearing the closure tools and rotating above and below the plane of the conveyor belt, and provided with covers.

29 Claims, 9 Drawing Sheets

Fig. 1

METHOD AND APPARATUS FOR CLOSING CONTAINERS

The present invention relates to a method of closing containers in which the containers are conveyed lying one behind the other on a conveyor in a horizontal plane to a closing station where closure tools traveling periodically in a rotary movement more towards the containers and the containers are then provided with a cover foil in a continuously advanced movement.

The invention also concerns an apparatus for closing containers with a cover foil which has a conveyor belt on which the conveyors are conveyed in a horiztonal plane to the entrance side of a closing station which comprises an upper rotating closure tool holder, which moves at least one closure tool in a circular path and at the same time lowers the closure tool periodically onto containers conveyed below the closure tool holder for the fastening of the cover foil.

A method and an apparatus of this kind are known, for instance, from British Pat. No. 923 741. Closing systems of this kind have the advantage over other systems, for instance those described in Federal Republic of Germany Pat. No. 2,913,026, that they operate continuously, i.e. that in systems of this type the containers need not be stopped in order to effect the pressing of the cover foil onto the customary rim flanges of the containers.

These continuously operating closure systems not only have the advantage over the intermittently operating systems that larger closing capacities (number of containers per unit of time) are possible with them, but they are also advantageous for the reason that it is not necessary to decelerate the containers, which in the case of the intermittently operating system has the result that, in general, complicated brake controls must be present so that, in particular, the liquid contained in the containers does not slosh over upon the braking.

This danger of sloshing is thus not present in the continuous closure systems.

In the case of continuous systems it is known, as shown by British Pat. No. 923 741, to arrange above the conveyor path on which the containers are conveyed to the closing station, a rotation system which moves around a plurality of closure tools around in a rotating movement, the tools closing the containers which are brought up one after the other. The containers are loosely covered already in front of the rotation systems by a cover foil which has been cut to size at a cutting station, said foils being then formed on the container in the rotation system by the tools. After the rotating tools have again released the containers, the latter are moved by the conveyor belt into a heat treatment zone so that a sealing takes place between the cover foil and the container.

This known closure system is, however, disadvantageous in certain respects. One important disadvantage is that the containers which are to be closed pass below the rotation system on the conveyor belt with a uniform speed of the conveyor belt. In order to bring the conveyor belt containers into engagement with the rotating tools, the latter are lifted out of their form-lock receivers in which they are conveyed on the conveyor belt by a cam-controlled lifting element and pushed into an on-coming tool.

Since, however, the tool is moving with a horizontal speed which changes continuously as a result of the movement of rotation while the horizontal speed of the conveyor belt remains at all times constant, problems of coordination arise upon the transfer of the containers to the rotating closure tool and upon reintroduction into the container receiver on the conveyor belt. To be sure, the rotation system can rotate with such a speed of rotation that the horizontal velocity of a closure tool corresponds to the speed of the conveyor belt upon the passage through the zero point of vertical speed, but in this way an equalization of the speed is obtained only over a very small region so that the closure tool can act on the container only over very small paths, particularly in the case of relatively high through-puts, without bringing about an excessive movement apart between container and associated container receiver in the conveyor belt.

Since the rotating tool thus can collaborate in coordinated manner with the containers only over short paths, the number of steps necessary for the closing which can be carried out with it is limited. Accordingly, in this known system the cover foils are already placed on the containers previously in a separate station behind the rotation system as seen in the direction of transport.

In particular, this known system is therefore unsuitable if the cover foil is to be fastened to the container by a flange closure, for which purpose it is necessary to exert a high pressing pressure by means of precisely aligned upper and lower tools. The same applies to high-quality sealed closures, for instance for sterilizable containers.

The object of the present invention is to improve the method and apparatus of the aforementioned type in such a manner that large total throughputs (containers per unit of time) can be reliably obtained with only a small amount of space being required and with a simple construction.

In order to achieve this, the aforementioned method is characterized by the fact that, upon entry into the closing station, the containers are transferred for further transportation to a rotating lower tool holder and, aligned by the latter, to the closure tool, transported through the closing station with a speed which corresponds to the corresponding horizontal speed of the rotating closure tool without vertical change in position.

In accordance with these features, the containers are passed through the closing station without vertical movement, in a constant horizontal plane which also corresponds to the plane of feeding, this taking place with a speed which corresponds in each case to the horizontal component of speed of the closure tools then acting on the container. In this way, the horizontal speed of the container upon passing through the closing station is adapted in each case to the horizontal speed of the closure tool, and the closure tool can thus act over a relatively long path on the container, despite the rotation drive. This affords the possibility of being able to carry out various method steps necessary, depending on the desired type of closure, at a single closing station and thus in space-saving manner. Due to the fact that the containers are passed through the closing station without vertical change in position and continuous horizontal movement is thereby assured, there is no danger of liquids which may have been introduced sloshing over during the passage through the closing machine.

In one very development embodiment of the method, the containers are closed by means of upper and lower tool halves which are periodically moved towards each other by upper and lower tool holders which travel in circular paths and, in a coupling phase, center the containers, provide them with a cover foil, fold the cover around a container rim flange in order to produce a flange closure and press the flange together with the cover, the maximum closing pressure being produced when the component of vertical movement of the rotation movement is zero. With these features, all steps necessary for the closing are carried out with complete synchronism of upper and lower tools during the coupling phase. In particular, all steps necessary for a firm flange closure, including the pressing, can be carried out in the coupling phase. The cooperation of upper and lower tools in combination with two rotating upper and lower tool holders furthermore results in the advantage that "soft" movements are obtained for the tool halves, this counteracting wear of the tools. The moving of the tool halves towards each other in a circular movement furthermore makes it possible for the containers to be closed in a continuous jolt-free operation. Since with travel of the tool rotation systems in the same direction the correct interaction of upper and lower tools in the coupling phase can be guaranteed, it is possible to operate with different freely selectable speeds and thus different quantity through-puts.

An apparatus of the aforementioned type solves this task in the manner that the closure station comprises a lower rotating tool holder which has at least one container holder (as tool) which is moved by the tool holder on the entrance side periodically into the plane of the conveyor belt and that upon reaching the plane of the conveyor belt positive guidance is provided for the container holder with respect to the tool holder in the manner that the container holder moves through the closing station, without vertical change in position with respect to the plane of the conveyor belt, in said plane with the corresponding horizontal velocity of the tool holder at the place of attachment of the container holder and that the upper closure tool holder and the lower tool holder rotate with the same speed of rotation and have their axes in a common vertical plane.

Due to the fact that a lower rotating tool holder is associated with the upper rotating closure tool holder and takes over the transport of the containers through the closure station formed in this way with the container holder associated with it, the speed of conveyance of the containers in the horizontal direction is in each case so controlled that it corresponds to the horizontal component of speed of the rotating tool holder. Thus no relative horizontal speed is produced between containers and closure tools. This equality of speed is obtained essentially by the positive horizontal guidance of the container holder plate arranged on the rotating tool holder, it taking over the containers from the conveyor belt. The container is thus conveyed by this plate through the closure station without vertical change in position.

A further development of the invention contemplates that the upper closure tool holder and the lower tool holder each have two double-armed rotary vanes between which, in each case, there extend cross bars on each of which there is fastened a closure tool or a container holder. By this development of the upper and lower tool holders light, simply constructed rotation systems are created. In this case the rotary vanes are advantageously driven via central shafts and the transverse members are mounted in the rotary vanes and a synchronous planetary gear system is arranged between the central shafts and the cross bars. The synchronous planetary gear system has the result that the cross bars, despite the rotary movement of the rotary blades, hold the tools or container holders fastened to them with positive guidance at all times in horizontal alignment.

Another development of the invention contemplates that the container holder is developed as a holder plate which, via a guide pin and a spring resting against the cross bar, is held at a vertical distance from the associated cross bar, the guide pin extending through a vertical bore in the cross bar member and terminating in a transverse plate. The container holder passes through a distance from the transverse plate brought about via the guide pin relatively early into the plane of the transport path and takes over the containers brought up so that the coordination of the horizontal velocity of container and closure tools takes place over a relatively large path. This development also affords the possibility of producing the horizontal positive guidance of the holder plate in simple manner in that the transverse plate is brought to rest against a horizontally extending stationary guide rail. In one very advantageous further development of the invention, it is provided that on the upper closure tool holder closure tool upper parts are fastened and on the lower tool holder closure tool lower parts are fastened, said parts being periodically moved towards each other by the rotation of their holders and cooperate in a coupling phase in the attaching of the cover foil.

The closure tool lower parts are advantageously arranged on the cross bars concentric to the holder plate so that they, in simple manner, can grip and work the containers placed on the holder plates. The closure tool lower parts can comprise a pressure frame and a centering basket. Pressure frame and centering basket can be developed as one piece. Alternatively, the centering basket can be supported, however, also for vertical displacement with respect to the pressure frame. The centering basket serves primarily for the precise alignment of the container present on the holder plate and, together with the pressure frame, forms upon the pressing the counter-pressure holder when the two tools halves in the position of the greatest approach of the cross bars by means of their tool pairing surfaces press the container edge together with a foil.

The vertical movement of the centering basket with respect to the pressure frame can be controlled via a cam roller which travels in a guide groove. In this way the centering basket can be used in the manufacture of flange closures by a suitable development of the guide groove also upon the forming of the cover foil which is folded around the edge flange of a container.

The guide groove is advantageously introduced into a stationary cam ledge the horizontally extending loewr edge of which forms the guide rail for the carrying plates. The cam ledge thus assumes both the controlling of the centering basket and the controlling of the carrying plate. If the cam ledge extends symmetrically to the perpendicular central plane towards both sides in each case by half the radius of the rotary vanes, there is thus the possibility, via a correspondingly large conveyor path, of controlling the carrying plate as well as the movements of the centering basket in such a manner that the necessary operations, such as centering, flanging and pressing of the cover, can be carried out one after the other.

A further development in this connection contemplates that the cam ledge is developed as part of a vertical hollow shaft which is mounted on the central shaft between the rotary vanes. The stopping of the hollow shaft can, for instance, be achieved in the manner that the hollow shaft is connected with an inner sun wheel which is held stationary via inner planet gears which are driven around common planet shafts by outer planet wheels rotating around the outer sun wheel of the synchronous planet gearing. In this way it is possible in simple fashion to hold the guide rails stationary between the rotary vanes without it being necessary to provide for this purpose a stationary attachment on the housing, which could only be provided with difficulty without impeding the cross-bar rotation.

A further development of the invention provides a blocking device which prevents a sudden accelerating of the rotary vanes by relief forces after passage through the vertical central plane. The blocking device creates an equalizing of clearance and loading for the upper and lower tool holders. The blocking device can be developed in the manner of an engaging pressure bearing. This is obtained, for instance, in the manner that the blocking device has opposite engagement rollers on the periphery of the rotary vanes of the lower tool holder as well as a blocking disk of smaller diameter than the rotary vanes and the axis of which lies together with the axis of the rotary vanes in a common vertical central plane which has two recesses arranged 180° apart to receive the engagement rollers and which is driven in opposite direction to the rotary vanes with a gear step-up ratio of the same peripheral speed as the rotary vanes. Furthermore, there can be provided in the periphery of the rotary vanes of the upper tool holder recesses into which the engagement rollers of the rotary vanes of the lower tool holder also engage.

In a further development of the invention, an intermediate transport device is provided which receives the containers from the conveyor belt by means of transport drivers which extend transverse to the direction of transport and are conducted revolving on a chain and pushes them via transfer curves extending in the transport plane onto the container holders which are guided horizontally in the transport plane. The transport drivers are preferably mounted swingably rearward away from the containers, after the transfer of the containers to the container holders, by a roller cam control in the transport plane. The transport drivers can be swung by a roller/cam control behind the then closed containers back into the transport path and thus push the containers from the container holders over transfer skids onto a removal belt. The intermediate transport system developed in this way promotes the continuous transfer of the containers onto the container holders of the lower tool holder and furthermore takes over the removal to a removal belt which follows.

In a further embodiment of the invention, the closure tool upper parts are so developed that they, in each case, place the cover foils onto the containers and, in cooperation with the tool lower parts, produce a flange closure, the closure tool upper part having pushers known per se which, in a closing movement, fold the cover foil under the edge flange of the container. The movement of the pushers takes place advantageously with the utilization of the relative movement between the cross bars and the rotary vanes of the closure tool holder. For this purpose there can be provided on at least one of the two rotary vanes cam curves which, via rollers, pendulum arms and coupling bars, which transfer their swinging movement via straps to the pushers, act on a cam disk arranged on the cross bar.

Finally, another embodiment of the invention provides that the closure tool upper and lower parts are developed as tools by which cover foils are fastened to the containers, with the formation of a seal closure.

The invention will be further explained and described below with reference to an embodiment, shown in the drawing, of a flange closing machine operating with upper tool and lower tool.

Figure 1:
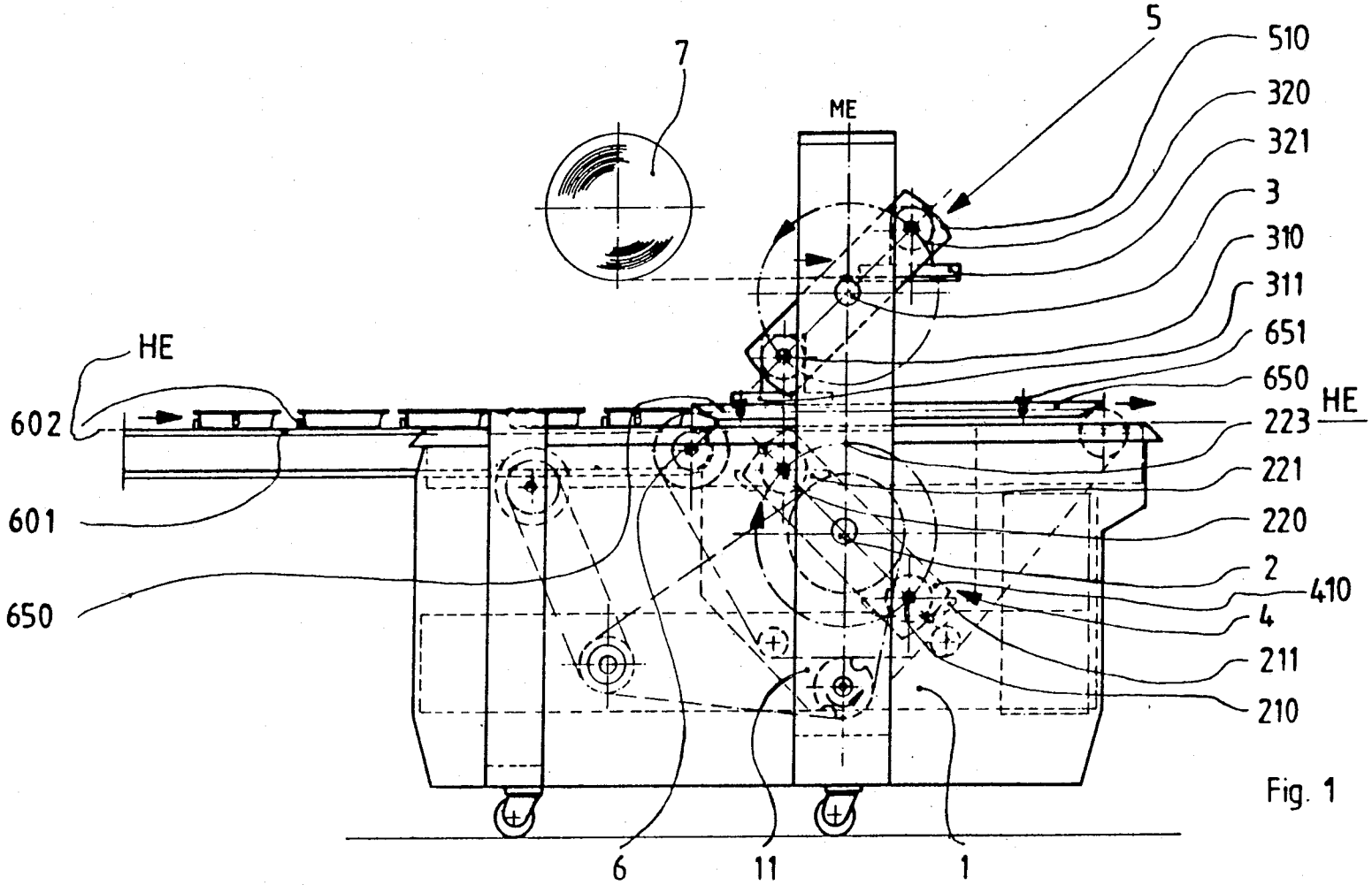
FIG. 1 shows a side view of the entire device.

FIG. 1 is an overall view of an apparatus in accordance with the invention. On a machine frame 1 there are fastened columns 11 on which there are mounted, in a common vertical central plane, the central shafts 2 and 3 of a lower tool holder 4 and an upper tool holder 5. The tool holders are referred to below as rotation systems.

The rotation systems 4 and 5 have rotary vanes 410 and 510 driven around the central shafts 2 and 3 respectively with constant speed of rotation, between which cross bars 210, 220 and 310, 320 respectively extend. The cross bars serve as holders for closure tool parts 211, 221 and 311, 321 which periodically rotate with same. These tool parts are periodically moved towards each other upon the rotational movement of the rotation systems 4 and 5 and, via a coupling phase, cooperate for the closing of the containers which are conveyed through between the closing station which is thus formed.

A cover foil is fed from a cover foil supply roll 7 to the upper rotation system 5 in a manner not explained in detail here and is then carried further by the closure tool upper parts 311, 321 to the containers.

Figure 2:
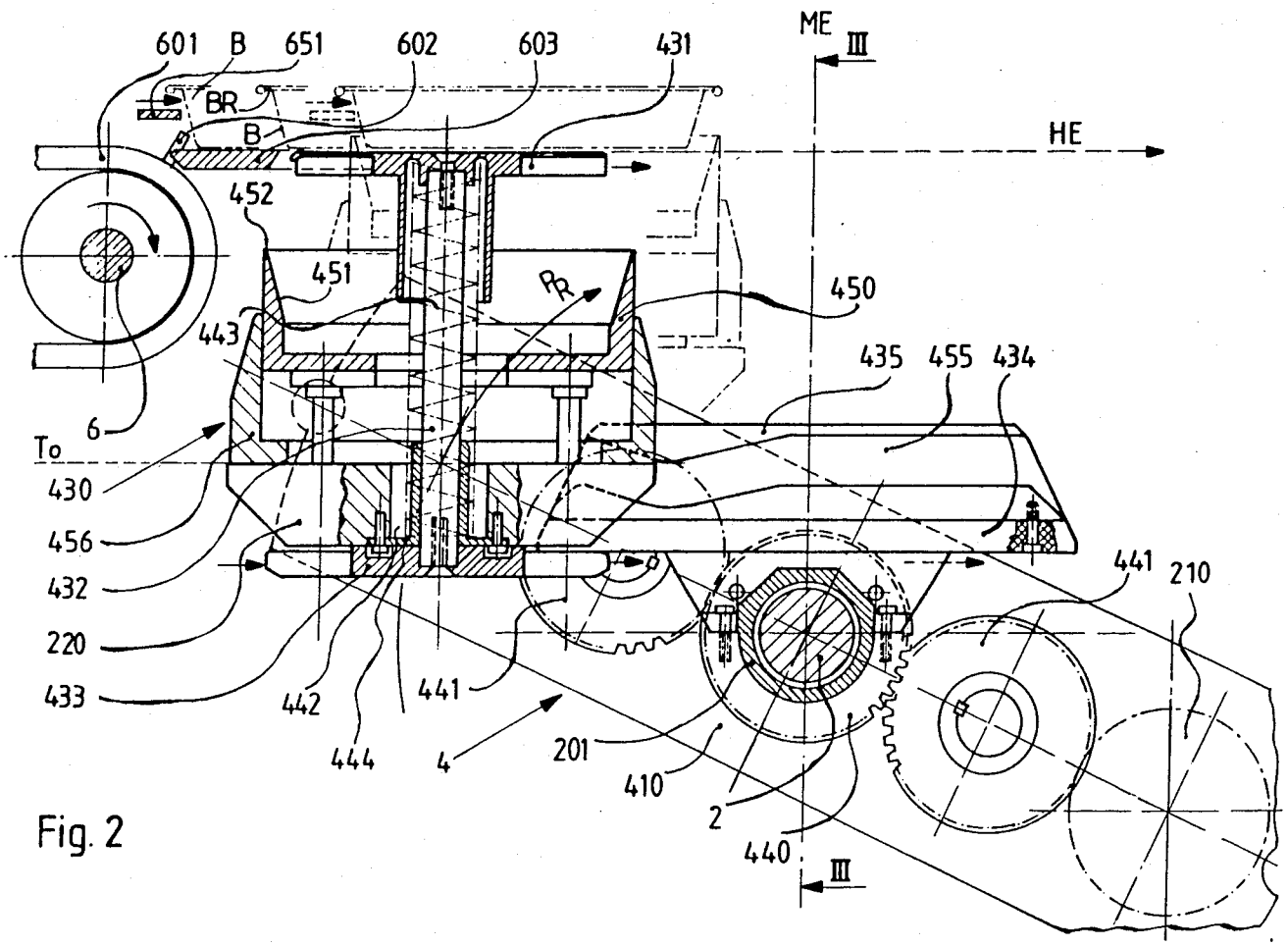
FIG. 2 is a side view of the lower tool holder.

In the sectional side view of FIG. 2 the construction of the lower rotation system can be noted in detail. The rotary vane 410 is driven around the central shaft 2 in the direction indicated by the arrow $P_r$ with constant speed of rotation. The cross bar 210 is mounted in the rotary vane (the cross bar present on the other rotary vane arm which is developed in identical manner and bears the tool underparts is not shown, in order not to clutter the drawing). The cross bar is positively guided by means of a synchronous planetary gear system in such a manner that the surface $T_o$ of the cross bar remains aligned horizontally during the entire rotation. The lower tool, designated generally as 430, is fastened on the cross bar. In the embodiment shown, the lower tool consists of a pressure frame 456, a centering basket 450 which is vertically displaceable with respect to the pressure frame, and the carrier plate 431 for the containers B. The carrier plate is attached to a guide pin 432. The guide pin extends through the centering basket 450, the pressure frame 455 and a borehole 442 through the cross bar and ends in a transverse plate 433. The container carrier plate 431 is supported on the cross bar by means of a mating holder 414 via a spring 443.

Fixed in position between the rotary vanes there is a guide ledge 434 which extends on both sides symmetrically to the central plane ME and bears alongside a cam ledge 435, with guide groove 455, which will be explained in detail further below, the guide ledge 434 with the lower edge of which the transverse plate 433 cooperates with the positive guidance of the carrier plate 431 in the horizontal plane HE.

Figure 3:
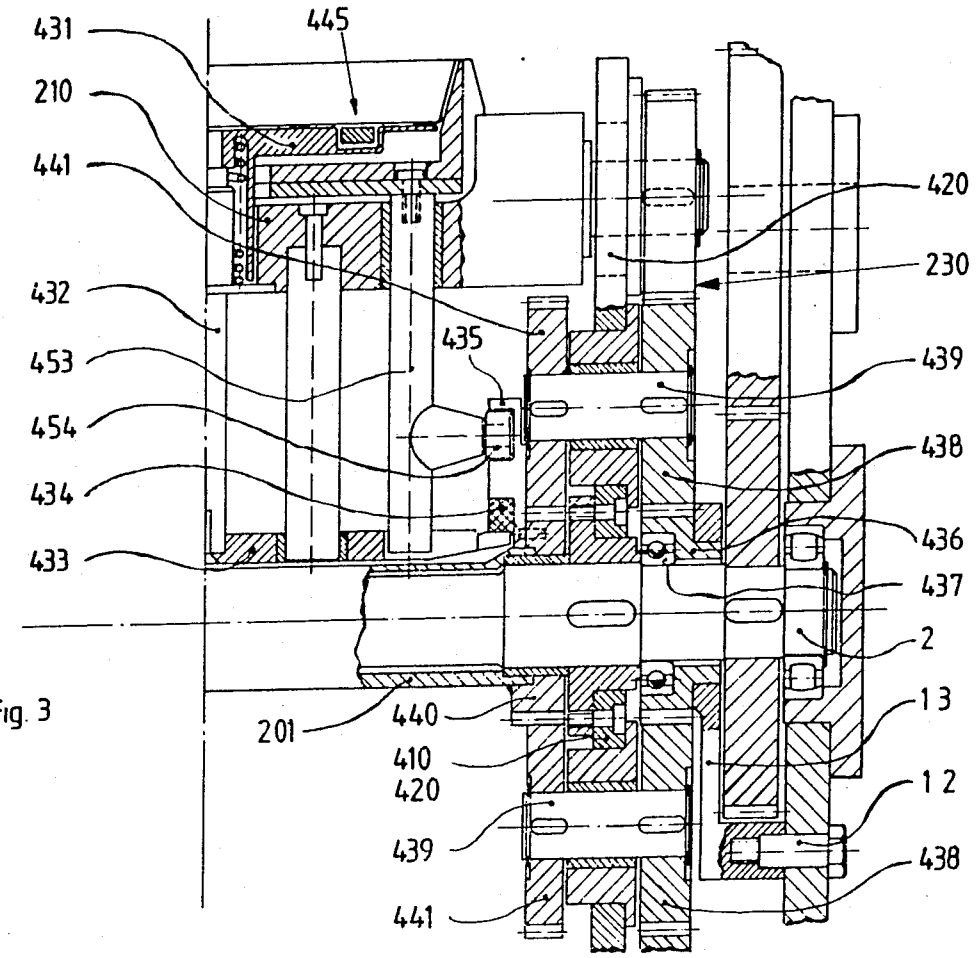
FIG. 3 is a section along the line III—III of FIG. 2 with the container holder in the central plane ME.
Figure 4:
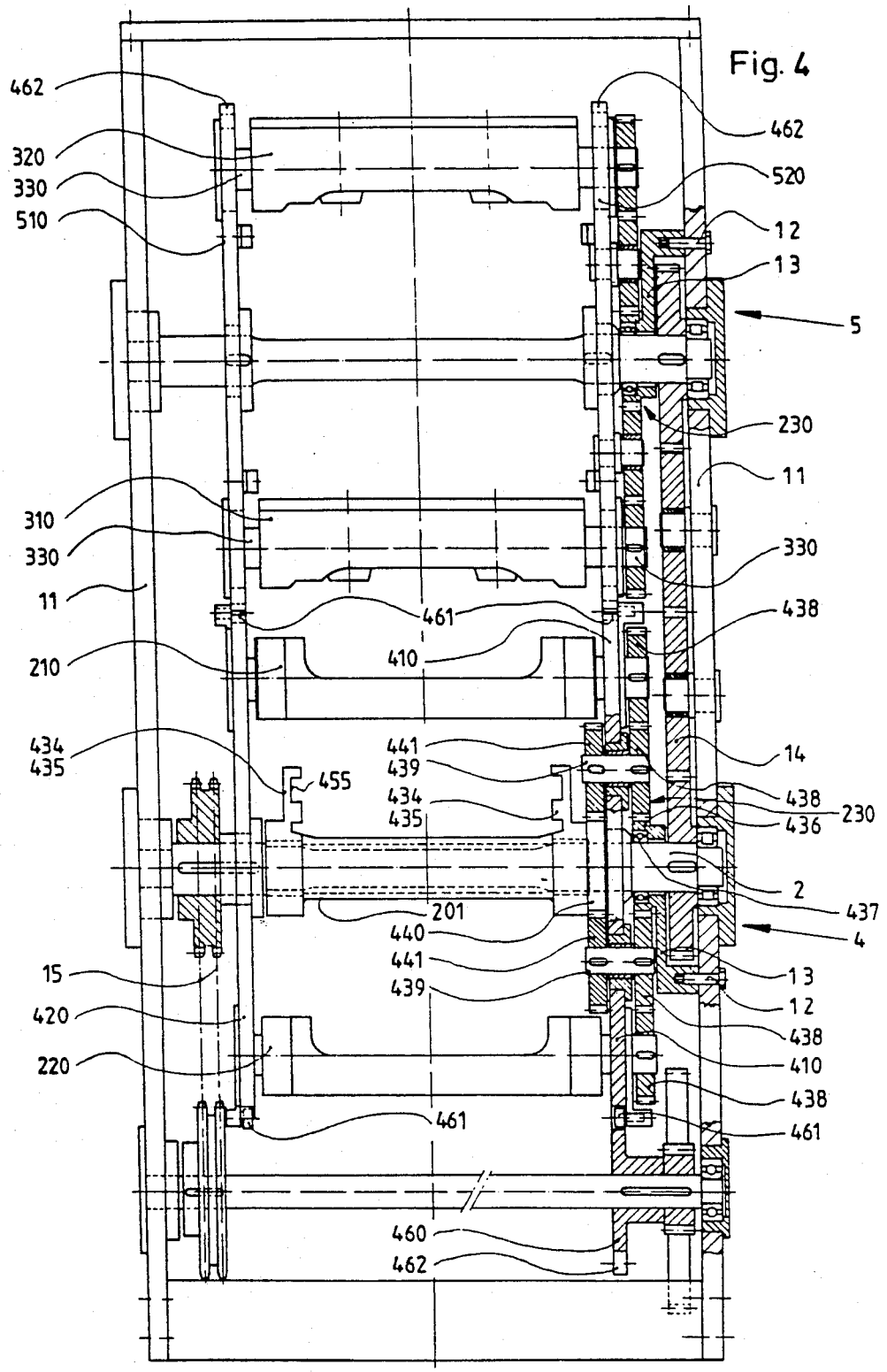
FIG. 4 is a cross section through the lower and upper tool holders and the blocking disk.

As can be noted from FIGS. 3 and 4, the cam ledge 435 is supported by a stationary hollow shaft 201 which is mounted on the rotating central shaft 2 between the rotary vanes 410 and 420. In order to hold the hollow shaft 201 stationary and thus the cam ledge 435 fixed in position, a flange plate 13 is fastened to the column 11 of the machine frame 1 via an anchor bolt 12 (see FIG. 4) the outer sun wheel 436 of the synchronous planet gearing being bolted to said plate.

This sun wheel rests via a bearing 437 on the central shaft 2. Via the outer stationary sun wheel 436 and the outer planet wheels 438 which rotate around this sun wheel and inner planet wheels 441 lying together with said planet wheels 438 on common planet shafts 439 the result is obtained that an inner sun wheel 440 stands still. To it there is fastened the hollow shaft 201 whihc, in its turn, bears the cam ledge 435.

On the cam ledge 435 there is furthermore arranged the aforementioned guide groove 455. With this guide groove 455 there cooperate cam rollers 454 which are arranged on centering basket guide columsn 453. The guide groove 455 extends, like the guide strip 434 for the transverse plates 433, up to far behind the vertical central plane ME of the rotation systems 4 and 5 and thus causes the centering basket to carry out the corresponding lifting and lowering movements relative to the central shaft which are necessary for the closing process.

Figure 5:
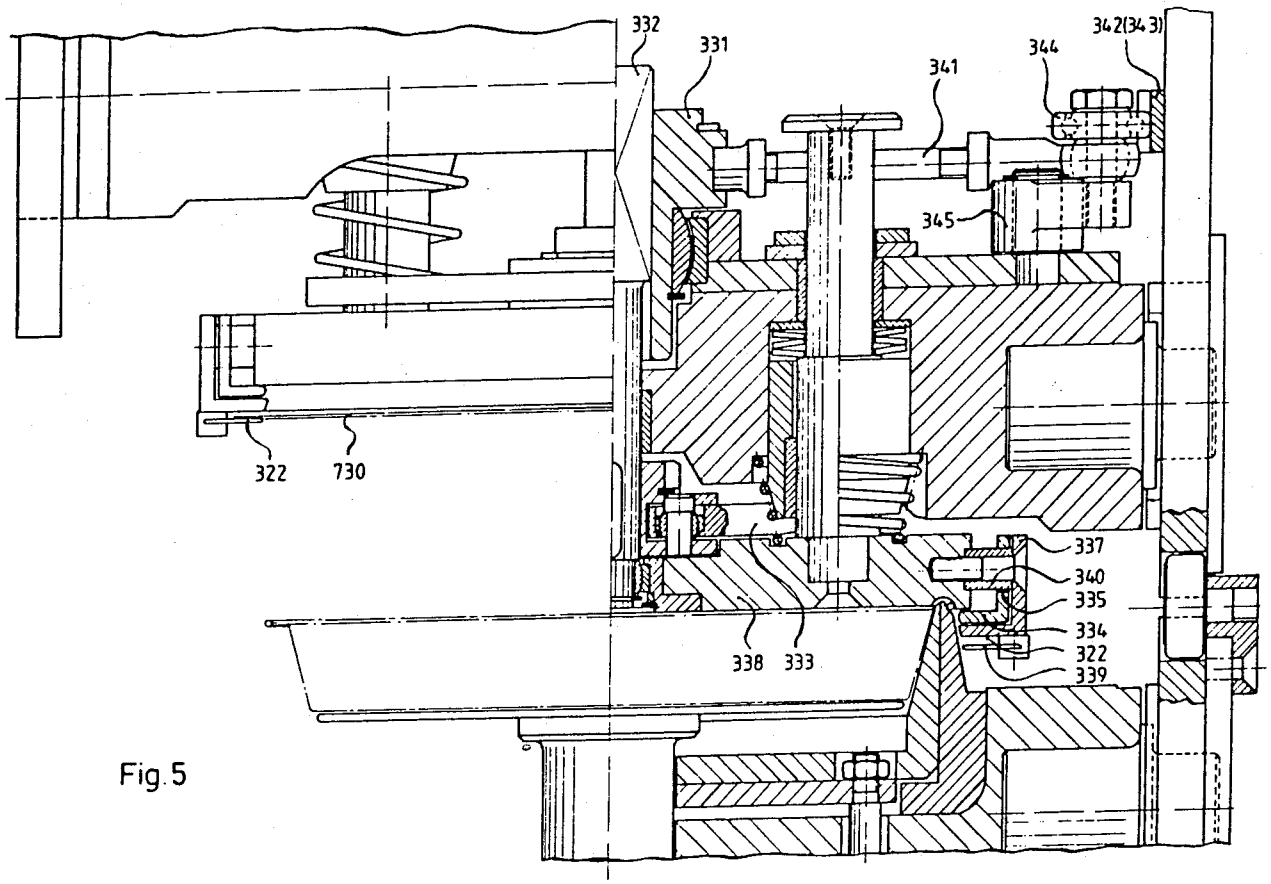
FIG. 5 is a cross section through the upper and lower closure tool halves.
Figure 6:
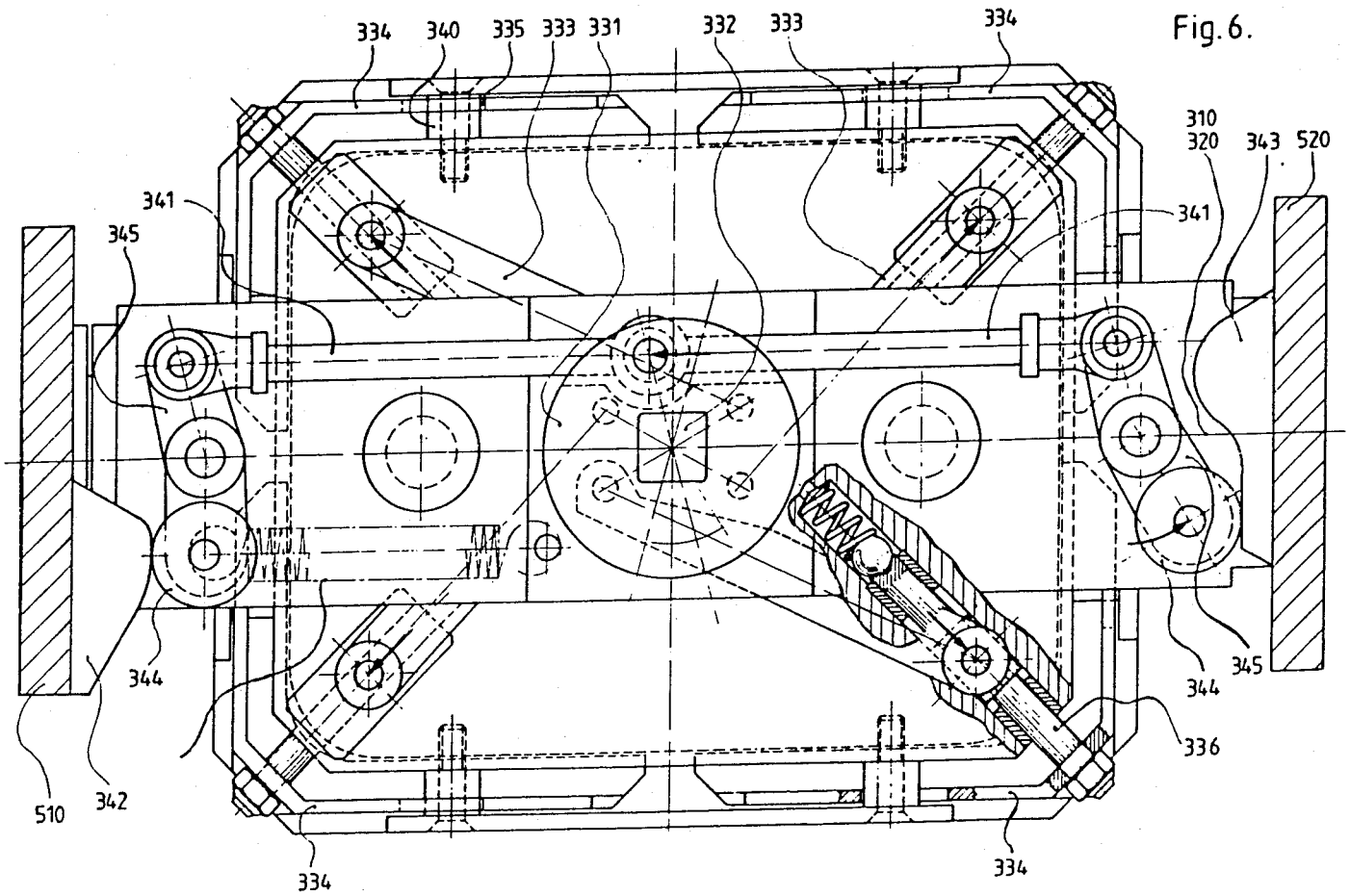
FIG. 6 is a top view of the closure tools.

Details of the upper rotation system will be explained below with reference to FIGS. 5 and 6. The closing system described here serves for the closing by flange closure of containers fed to it. The two upper tools 311, 321 (see FIG. 1) are mounted rotatably on their cross bars 310, 320 but are also held via the synchronous planet gears (see FIG. 4) in their horizontal position during the rotation of the system. For the production of flange closures it is known per se to operate with pushers 334 which fold a cover foil part protruding downward beyond the edge flange of the containers inward towards the wall of the container. For this folding of the cover foil below the edge flange of the container, the pushers must carry out a closing movement. For the controlling of the pusher, the fact is utilized that, during the rotation of the entire system, the cross bars are always held in horizontal position while the rotary vanes 510 and 520 rotate around the central shaft 3 of the upper tool. In this way, relative movement is produced between the horizontally held cross bars and the rotating rotary vanes. In order to utilize this relative movement for the control of the pushers there are arranged on the cross bars 310, 320 swing disks 331 which, via form-locked center pins 322, transmit the oscillating swinging moment produced via straps 333 to the pushers 334. The pushers are guided in guides 335 and guide pins 336. The push-in frame 337 assumes also a guide function. This push-in frame is firmly mounted on the top plate 338 of the upper tool. The top plate rests under spring load against the cross bar. The push-in frame together with the carrier skids 339 forms the carrier guides 322 for a cover-foil piece 730 which has been fed to the upper tool. The carrier skids 339 could also be fastened directly to the spacer pieces 340 so that the push-in frame could then be dispensed with.

The cover foil guidance could then be taken over by stronger pushers 334 in combination with the carrier skids 339.

The swinging movement for the production of the pusher movement is transmitted via coupling rods 341 to the swing disks 331. This movement is produced by cams 342, 343 which are arranged on the rotary vanes 510 and/or 520 and, via rollers 344 and pendulum areas 345, drive the coupling rods. It would also be possible to effect the positive control of the pusher movement only in one direction, the movement in the other direction taking place then, for instance, by the use of springs.

In order to produce the required closing pressure the pressure frame of the lower tool half cooperates with the pressure plate 338 of the upper tool half, the greatest pressure being exerted when the two tools pass through the vertical central plane ME of the rotation systems. In this connection the springs by which the pressure plate of the upper tool is supported in the cross bar are compressed. Since other compression and tension springs of the rotation systems also have their highest stress in this position, means are provided which, upon the release of these springs after going beyond the central plane ME, prevent a springing back of the upper and/or lower rotation system. These means are explained further below with reference to FIGS. 4 and 7. In those figures it can be noted that below the lower rotation system 4 on the same vertical central plane ME on which the central shafts of the rotation systems are also located there is arranged a blocking disk 460 which rotates in opposite direction from the lower rotation system and has a smaller diameter than the rotation systems. In this blocking disk 460 there are provided two recesses 462, 180° apart, to receive engagement rollers 461 present on the rotary vanes 410 and/or 420. Upon every 180° rotation of the rotary vanes these engagement rollers grip in form-locked manner into the recess 462. By a step-up transmission, the sudden acceleration of the rotation systems upon the release from the closing pressure is thereby weakened, the rotary vanes following in the movement of rotation of the blocking disk. By a gear step-up transmission the same peripheral speed of the smaller blocking disk with respect to the larger rotary vanes is assured. The engagement rollers 46 arranged opposite on the periphery of the lower rotary vanes 410, 420 engage, on the one hand, into the blocking disk 460 and also into recesses on the periphery of the upper rotary vanes 510, 520. This produces also an equalization of the play of the drive elements of the upper and lower rotation systems during the engaging of the oppositely moving tool halves in one another.

Figure 7:
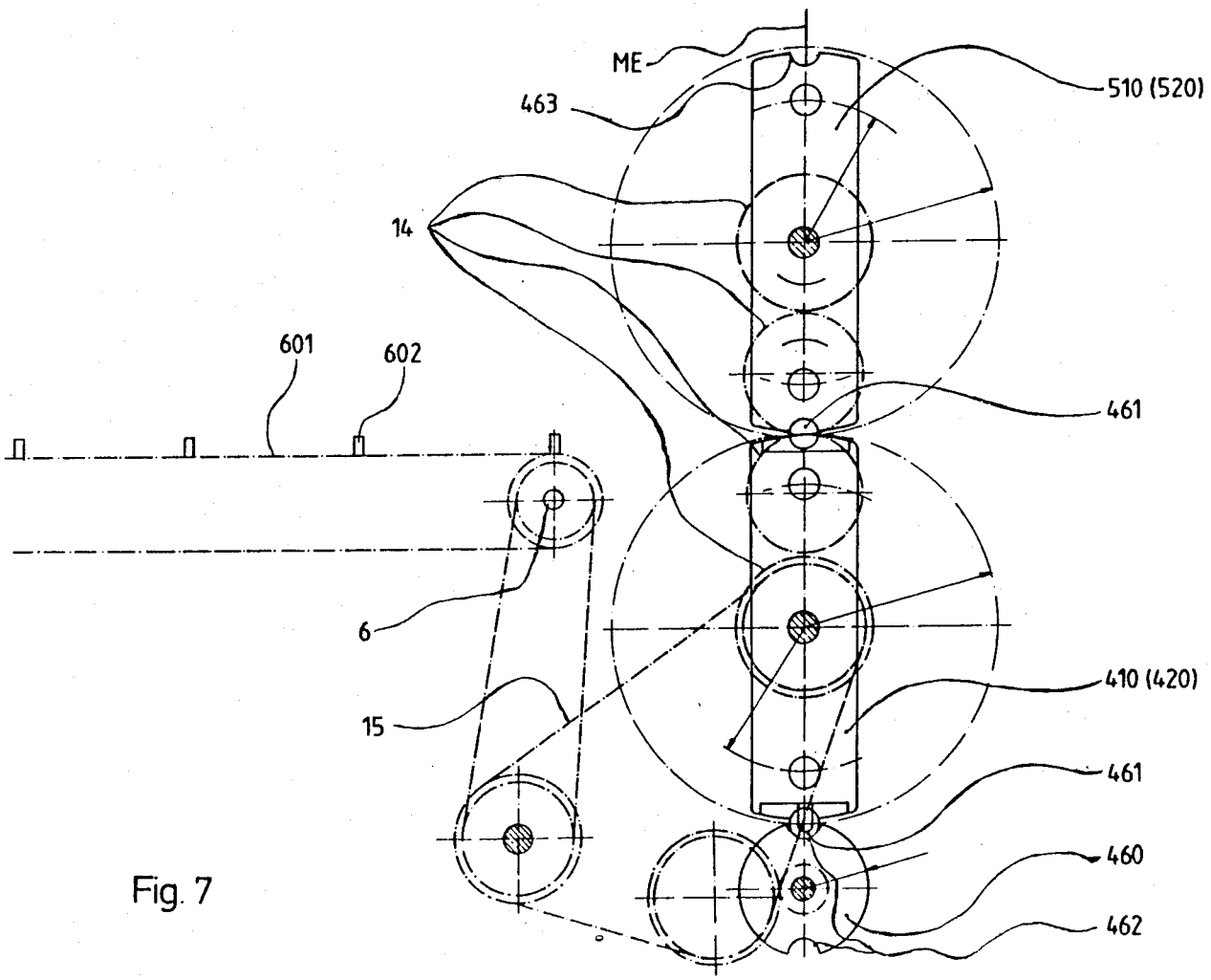
FIG. 7 is a side view of the drive diagram of the rotating tool holders of the conveyor belt and the blocking device.

In particular, from FIG. 7 it can furthermore be noted that the main drive 15 of the rotation systems is also connected with the conveyor belt drive shaft so that the movements of rotation of the rotation systems are coordinated with the movement of the conveyor belt 601.

Figure 8:
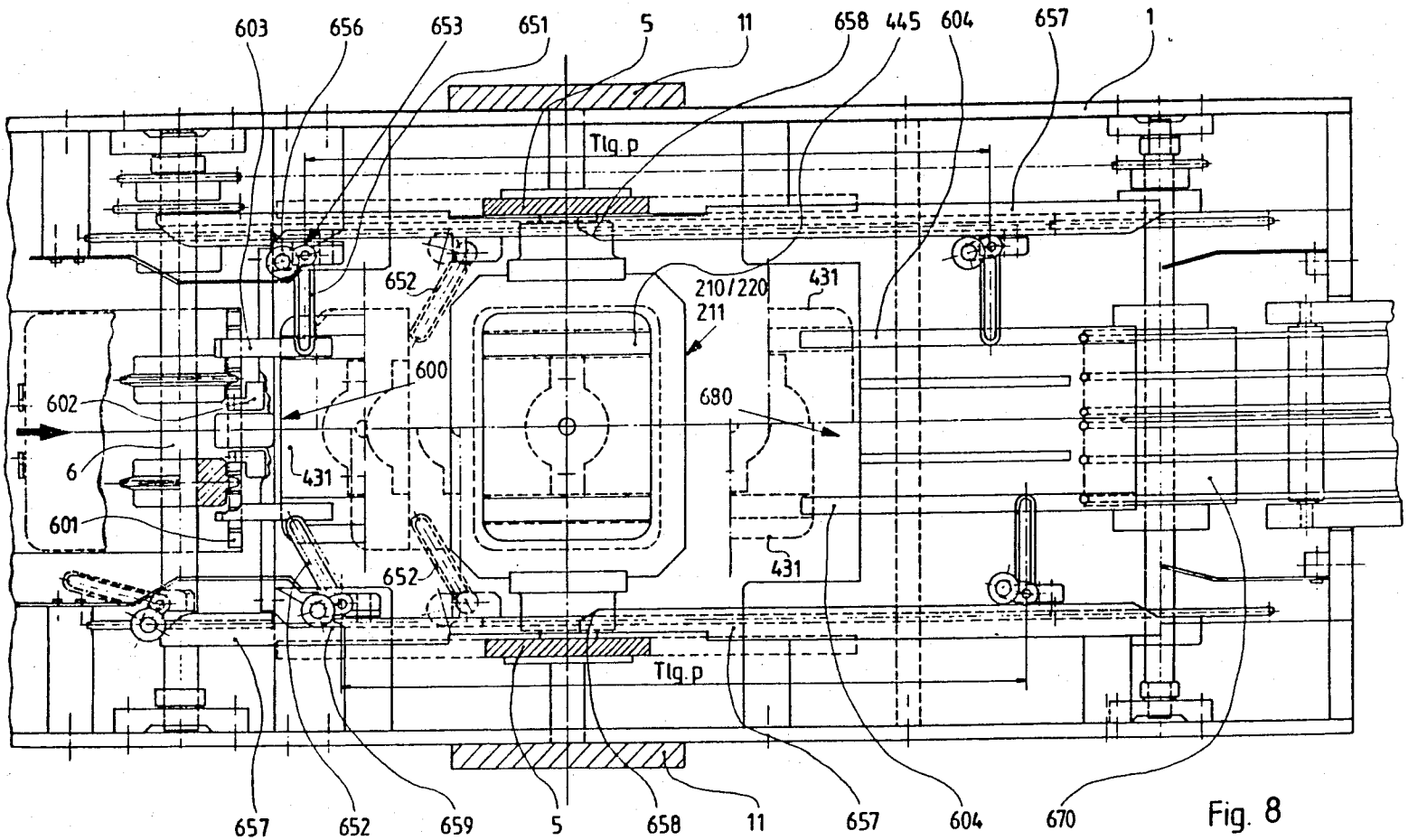
FIG. 8 is a top view of the container transport system.
Figure 9:
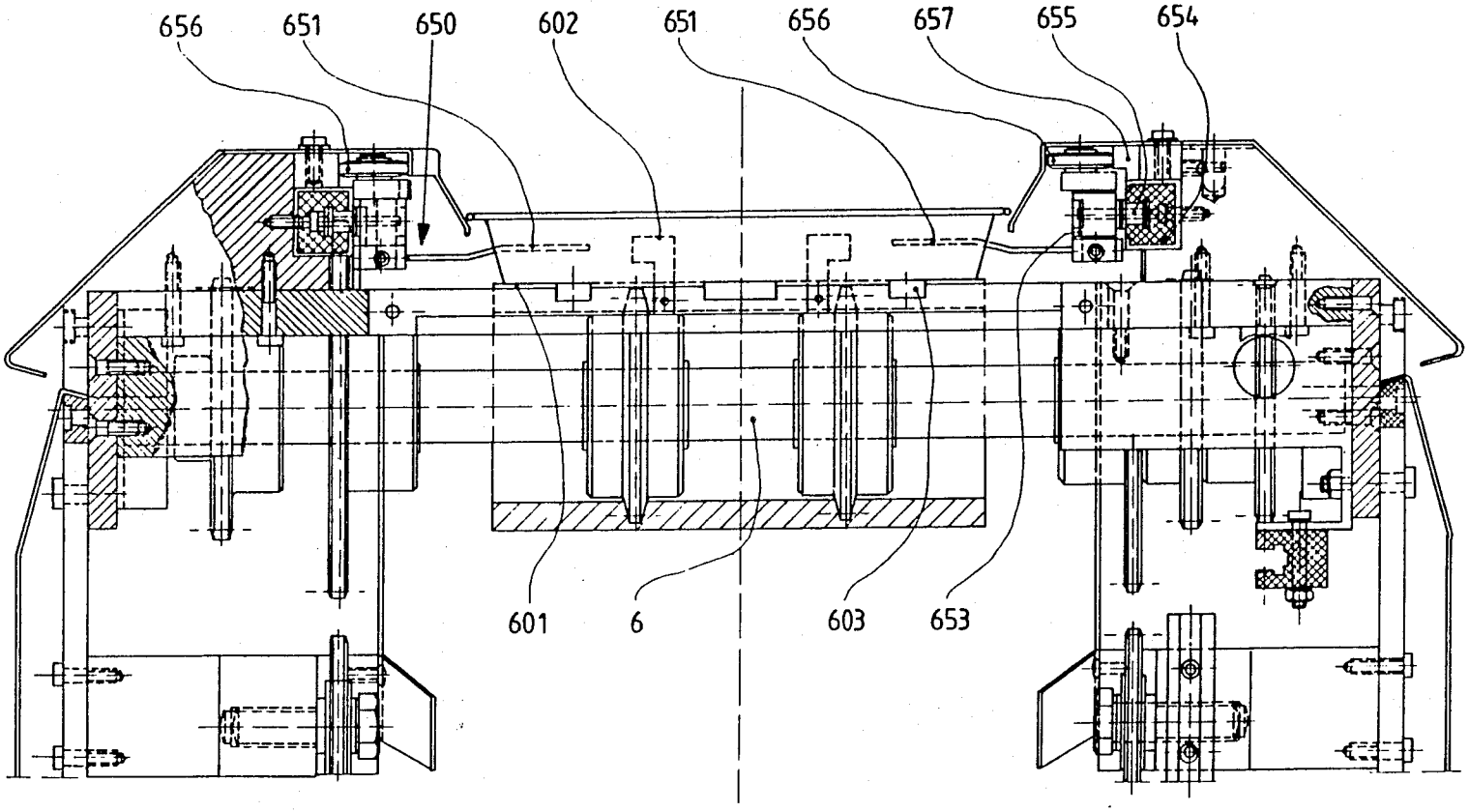
FIG. 9 is a cross section through the transfer skids and the intermediate transport.

The container transport will be explained in detail below with reference to FIGS. 8 and 9. On the conveyor belt 601 the containers are moved, as shown in FIG. 8, from left right to the closing station formed by the rotation systems 4 and 5. The advancing at suitable intervals is assured by means of conveyor belt drivers 602 fastened on the conveyor belt. The transfer from the conveyor belt 601 and the conveyor belt drivers 602 to the carrier plate 431 of the lower rotation system takes place by means of an intermediate conveyor transport system 650. This intermediate transport system comprises drivers 651 which can be swung from the side into the transport path of the containers. The drivers 651 are fastened to driver holders 653 which, in their turn, are held on a duplex chain link of a single roller chain 655 traveling in guides 654. The drivers 651 are swingably pivoted with respect to the driver carriers. Furthermore, run-on rollers 656 which cooperate with cam ledges 657 during the transport of the containers are connected to the drive carriers.

The drivers 651 take over the containers from the conveyor belt drivers 602 before the latter move down around the drive shaft 6 out of the movement and push them over the transfer skids 603 onto the carrier plate 431. For the assuring of smooth transfer movement there are arranged in the carrier plate 431 longitudinally extending slits 445 which make it possible for the carrier plate 431 to overlap the transfer skids 603 by a certain distance in the direction of conveyance in the horizontal transport plane. In corresponding manner, the carrier plate can then, on the delivery side, convey the containers in a gentle movement onto the transfer skids 604 which are provided there. While the carrier plate takes over the transport of the container between the rotation systems, the drivers 651 swing back controlled (652) by the run-on rollers 656 which roll along the cam ledges 657 and in this position they are further transported by the chain 655. By the swinging back of the drivers, assurance is had that they will not interfere with the closing process uponthe cooperative action of the closure-tool halves. In this connection, it is sufficient to swing the drivers about 30° to the rear from their straight position since the drivers pass through the closing station with approximately the same speed as the container. On the delivery side, the run-on rollers 656 act on a cam 658, with the result that the drivers now again assume their position facing transverse to the direction of transport. The drivers then push the container over the transfer skids 604 onto a delivery belt 670. The intermediate transport elements are then guided back again to the inlet side on the chain through the machine frame 1.

Upon the carrying out of the method the apparatus operates as follows:

A container resting on the conveyor belt 601 against the drivers 602 is pushed at the end of the conveyor belt over stationary transfer skids 603 onto the carrier plate 431 which first of all advances by the length of the guide pin 432 in vertical direction with respect to the lower tool 430. The lower rotation system 4 has reached the position shown in FIG. 1. While the conveyor belt 601 is now moved around the conveyor drive shaft 6, the conveyor belt driver 602 which also moves away downward pushes the container over the transfer skids 603 in the direction towards the carrier plate 431. In this connection, the containers are gripped, without stopping, by the intermediate conveyor drivers 651 and pushed further over the transfer skids onto the carrier plate 431 the vertical movement of which has just been stopped by the coming of the transverse plate 433 against the guide ledge 434 and which now moves exclusively horizontally, it being accelerated through the peak point of the circular path 223 of the lower rotation system as a result of the increasing horizontal component of speed of the rotary movement of the system, in order then to be delayed again to the same extent in this component. If now the rotary movement is continued from the position shown in FIG. 1, the lower tool (centering basket and pressure frame) moves further upward out of the position shown. After passing through a certain angle of rotation, the centering basket 450 with the help of its inner thread 451 takes over and centers the container B present on the carrier plate. The inner container receiver of the centering basket is advisedly so developed in accord with the dimensions of the container B that the upper rim 452 of the centering basket 450 extends to below the horizontal rim flange BR of the container, a slight lifting (1 to 2 mm) of the container being possible for the absolute central centering thereof on the carrier plate 431. After the centering, the centering basket is not moved higher by means of the guide groove 455 but is lowered again so as to make room for the cover rim which has now been pushed inward by the upper tool over the rim flange of the container. This cover rim is in a first phase folded vertically downward and is then in a second phase pushed by means of the pusher below the container rim flange and brought, in part, up to the downwardly tapering outer wall of the container. Thereupon the centering basket is again moved upward in the direction towards the rim of the container by control via the groove 455. During these processes, the rotation systems come closer and closer to the position in which the cross bars of the tool halves which are moved towards each other pass through the point of maximum approach (peak point 223 of the circular path). Upon this approaching movement, the pressure frame 456 which is fastened to the cross bar 210 is moved further and further upward for the pressing of the cover rim which is bent below the rim flange of the container. The final closure pressure is obtained by cooperation of the pressure plate 338 of the upper tool with the pressure frame 456 when the closure-tool upper and lower parts are on the vertical central plane ME of the rotation systems.

The container, which is now provided with a flange closure, is then conveyed to the delivery side, this further conveyance taking place further in the horizontal plane HE on the basis of the positive guidance of the container carrier plate 431 and of the centering basket 450. Upon the moving apart of the tools, the blocking disk and the engagement rollers prevent sudden jerking of the rotation systems.

In the meantime, the drivers of the intermediate transport system have also been moved in their swung position over the center plane ME. In the further movement, the carrier plate moves further horizontally while, however, the lower tool 430 moves away downward on the cross bar, the horizontal component of the speed of rotation becoming constantly smaller. The drivers 651 now take the container over from the carrier plate which is becoming slower and push it over the delivery transport skids 604 further onto a delivery belt 670 while the transport plate then also dips off. In the meantime, the complementarily arranged second lower tool comes from below within the entrance region 600 of the containers and the processes take place again in coordination with the second upper tool, in the manner which has been described. Since the course of movement of the rotation systems, the transport systems and the closure tools are mechanically coupled, the speed with which the device operates can be freely selected in simple fashion. The gentle alternating horizontal and vertical components of the movements bring it about that the tools are very trouble-free even with a high operating speed of the entire system. In contradistinction to stationary systems with purely linear movement, the tool halves in the case of the invention are not subject to any wear as a result of sudden, vigorous closing movements. Furthermore, the air inclusions between container/lid/tool which are frequently present in the case of rapid closing movements and lead to barreling of the packings are avoided. All steps necessary for the closing of a container, including the placing on of prefabricated or formed cover foils, can be carried out at one station as a result of the coordination of the conveyance movement of the containers so that the entire apparatus, as a whole, is very compact.

The method described and the apparatus are suitable for the manufacture of both flanged and sealed closures by the use of suitable tools. Furthermore, containers with vertically erect closure rim and with insert lids can also be closed by the method of the apparatus [sic]with corresponding modification of the tools. In addition to the different type of tools used, the apparatus can also be modified in the manner that the cross bars are not supported with continuous shafts on both sides on rotary vanes but that only a single-sided mounting on only one rotary vane is provided. Furthermore, of course, one can operate with more than two tool units per rotation system.

We claim:

1. A method of closing containers comprising conveying containers to be closed, lying one behind the other on a feed conveyor, in a horizontal plane to a closure station, and, at the closure station, effecting continuous continued movement of each container delivered thereto while causing each said delivered container to be engaged by a closure tool which revolves periodically in a movement of rotation for closing each said delivered container with a cover foil, wherein the improvement comprises:

transferring each said delivered container, upon entrance into the closure station, for further transportation to a rotating lower tool holder, and transporting each said delivered container, by the lower tool holder to which it is transferred, aligned with the closure tool that engages the same container through the closure station without vertical change in position, at a speed which corresponds to the corresponding horizontal speed of that rotating closure tool.

2. A method according to claim 1, wherein the containers are closed by moving upper and lower tool halves periodically towards each other by upper and lower tool carriers which travel in circular paths and in a coupling phase center the containers, provide them with a cover foil, fold the cover around a container rim flange and press the flange together with the cover in order to produce a flange closure, the maximum closing pressure being produced when the vertical component of movement of the rotational movement is zero.

3. An apparatus for the closing of containers with a cover foil, comprising a closure station having an entrance side and comprising at least one closure tool and an upper rotating closure tool holder which moves said at least one closure tool in a circular path and lowers the closure tool periodically onto containers conveyed below the closure tool holder for the fastening of the cover foil, and a conveyor belt on which the containers are conveyed in the horizontal plane to the entrance side of the closure station, wherein the improvement comprises:

the closure station further comprising a lower rotating tool holder including at least one container holder having a place of attachment to the lower tool holder, said at least one container holder being guided by the lower tool holder on the entrance side periodically into the plane of the conveyor belt, and means for providing positive guidance for said at least one container holder upon reaching the plane of the conveyor belt with respect to the lower tool holder such that the container holder moves without changing vertical position with respect to the plane of the conveyor belt in this plane with the corresponding horizontal velocity of the lower tool holder at the place of attachment of the container holder through the closure station, and an upper rotating closure tool holder, said upper and lower tool holders being arranged to travel with the same speed of rotation and having their respective rotational axes in a common vertical plane.

4. An apparatus according to claim 3, wherein each of the upper and lower tool holders includes two double-armed rotary vanes and cross bars between the vanes, each of said cross bars having a closure tool and/or a container holder fastened thereto.

5. An apparatus according to claim 4, further including central shafts for driving the rotary vanes; wherein the cross bars are mounted in the rotary vanes; and further including a synchronous planetary gearing system arranged between central shafts and cross bars.

6. An apparatus according to claim 4, wherein the container holder comprises a carrier plate and means for holding the carrier plate at a vertical distance from the cross bar to which the container holder is fastened, said last-mentioned means including a guide bolt and a spring resting against the last-mentioned cross bar, said last-mentioned cross bar having a vertical borehole through which the guide bolt extends, and said guide bolt terminating in a transverse plate.

7. An apparatus accordign to claim 6, further including a horizontally extending fixed guide rail, the transverse plate being moved resting against said guide rail for positive horizontal guidance.

8. An apparatus according to claim 3, including closure-tool upper parts fastened on the upper closure-tool holder and closure-tool lower parts fastened on the lower tool holder, said parts being periodically moved towards each other by the rotation of the tool holders and cooperating in a coupling phase for the attachment of the cover foil to a container.

9. An apparatus accordign to claim 4, wherein the container holder comprises a carrier plate and means for holding the carrier plate at a vertical distance from the cross bar to which the container holder is fastened, said last-mentioned means including a guide bolt and a spring resting against the last-mentioned cross bar, said last-mentioned cross bar havig a vertical borehole through which the guide bolt extends, and said guide bolt terminating in a transverse plate; including closure-tool upper parts fastened on the upper closure-tool holder and closure-tool lower parts fastened on the lower tool holder, said parts being periodically moved towards each other by the rotation of the tool holders and cooperating in a coupling phase for the attachment of the cover foil to a container; and wherein the closure-tool lower parts are arranged on the cross bars concentric to the carrier plate.

10. An apparatus according to claim 8, wherein the closure-tool lower parts comprise a pressure frame and a centering basket.

11. An apparatus according to claim 10, wherein the pressure frame and the centering basket are a single part.

12. An apparatus according to claim 10, wherein the centering basket is mounted for vertical displacement with respect to the pressure frame.

13. An apparatus according to claim 12, further including a cam roller, and a guide groove in which the cam roller travels, for controlling the vertical movement of the centering basket with respect to the pressure frame.

14. An apparatus according to claim 13, further including a fixed cam ledge into which the guide groove is introduced; wherein each of the upper and lower tool holders includes two double-armed rotary vanes and cross bars between the vanes, each of said cross bars having a closure tool and/or a container holder fastened thereto; wherein the container holder comprises a carrier plate and means for holding the carrier plate at a vertical distance from the cross bar to which the container holder is fastened, said last-mentioned means including a guide bolt and a spring resting against the last-mentioned cross bar, said last-mentioned cross bar having a vertical borehole through which the guide bolt extends, and said guide bolt terminating in a transverse plate; and further including a horizontally extendign fixed guide rail, the transverse plate being moved resting agaist said guide rail for positive horizontal guidance; said cam ledge having a horizontally extending lower edge which forms the guide rail for the transverse plate.

15. An apparatus according to claim 14, wherein the cam ledge extends towards both sides symmetrically to said common vertical plane in each case by approximately half the radius of the rotary vanes.

16. An apparatus according to claim 14, further including central shafts for driving the rotary vanes and a stationary hollow shaft mounted on the central shaft that drives the rotary vanes of the lower tool holder, between the last-mentioned rotary vanes.

17. An apparatus according to claim 16, wherein the cross bars are mounted in the rotary vanes; and further including a synchronous planetary gearing system arranged between central shafts and cross bars and comprising an inner sun wheel, inner planet wheels, outer planet wheels, common planet shafts on which both the inner and outer planet wheels are driven, and an outer sun wheel, said inner sun wheel being connected with said hollow shaft and being held stationary via said inner planet wheels, and said outer planet wheels revolving around the outer sun wheel.

18. An apparatus according to claim 4, further including a blocking device for preventing abrupt acceleration of the rotary vanes by relaxation forces after passing through said common vertical plane.

19. An apparatus according to claim 18, wherein the blocking device comprises opposite engagement rollers on the periphery of the rotary vanes of the lower tool holder, a blocking disk which is of smaller diameter than the rotary vanes, the axis thereof lying in said common vertical plane, and which has two cutouts 180° apart to receive the engagement rollers, and a gear step-up transmission for driving the blocking disk in a direction opposite to an with the same peripheral speed as the rotary vanes.

20. An apparatus according to claim 19, wherein, in the periphery of the rotary vanes of the upper tool holder, there are recesses into which the engagement rollers of the rotary vanes of the lower tool holder engage.

21. An apparatus according to claim 3, further including an intermediate transport device for taking over the containers from the conveyor belt, said intermediate transport device comprising transport drivers which face transverse to the direction of conveyance, a chain, and transfer skids extending in the transport plane, said drivers being conducted revolving on said chain, and pushing each container, over said skids, onto a container holder.

22. An apparatus according to claim 21, further including a roller-cam control for swinging the transport drivers in the conveyor plane towards the rear away from the containers after the drivers have turned over a container to a container holder.

23. An apparatus according to claim 22, wherein the roller-cam control includes means for swinging the transport drivers back into the transport path behind the closed containers after the closing of the containers; and further including second transfer skids and a delivery belt, so arranged that said transport drivers, when swung back into the transport path as aforesaid, push the containers from the container holder over the second transfer skids onto the delivery belt.

24. An apparatus according to claim 8, wherein the closure tool upper and lower parts comprise tools by which the cover foils are fastened to the containers with the formation of a flange closure.

25. An apparatus according to claim 24, wherein the closure tool upper part has pushers which, in a closing position, fold the cover foil below the rim flange of the container.

26. An apparatus according to claim 25, wherein each of the upper and lower tool holders includes two double-armed rotary vanes and cross bars between the vanes, said cross bars being movable relative to their associated vanes, and each of said cross bars having a closure tool and/or a container holder fastened thereto; and wherein the pusher movement is controlled with the utilization of the relative movement between the cross bars and the rotary vanes of the upper tool holder.

27. An apparatus according to claim 26, further including means for controlling the pusher movement, said last mentioned means comprising cams arranged at at least one of the two rotary vanes of the upper tool holder, rollers, pendulum arms, coupling bars, a swing disk arranged on the cross bar, and straps, said cams acting via said rollers, said pendulum arms, and said coupling bars, on said swing disk arranged on the cross bar, which transfers their swinging movement via said straps to the pushers.

28. An apparatus according to claim 8, wherein the closure-tool upper and lower parts are tools by which cover foils are fastened to the containers with the formation of a seal closure.

* * * * *